US010397717B2

(12) United States Patent
Lee et al.

(10) Patent No.: US 10,397,717 B2
(45) Date of Patent: Aug. 27, 2019

(54) ACOUSTIC DIAPHRAGM AND SPEAKER CONTAINING THE SAME

(71) Applicant: MING CHI UNIVERSITY OF TECHNOLOGY, New Taipei (TW)

(72) Inventors: Jyh-Wei Lee, New Taipei (TW); Jen-Chun Chang, New Taipei (TW); Yi-Jie Liao, New Taipei (TW)

(73) Assignee: Ming Chi University of Technology, New Taipei (TW)

( * ) Notice: Subject to any disclaimer, the term of this patent is extended or adjusted under 35 U.S.C. 154(b) by 0 days.

(21) Appl. No.: 15/988,539

(22) Filed: May 24, 2018

(65) Prior Publication Data

US 2018/0343532 A1 Nov. 29, 2018

(30) Foreign Application Priority Data

May 24, 2017 (TW) ..... 106117077 A

(51) Int. Cl.

| | |
|---|---|
| ***H04R 31/00*** | (2006.01) |
| ***H04R 7/12*** | (2006.01) |
| ***H04R 9/02*** | (2006.01) |
| ***H04R 9/06*** | (2006.01) |

(52) U.S. Cl.

CPC ..... *H04R 31/003* (2013.01); *H04R 7/125* (2013.01); *H04R 7/127* (2013.01); *H04R 9/025* (2013.01); *H04R 9/06* (2013.01); *H04R 2307/027* (2013.01); *H04R 2307/204* (2013.01)

(58) Field of Classification Search

CPC .. H04R 31/003; H04R 2307/027; H04R 7/16; H04R 2307/204; C22C 45/10; C22C 45/00; C22C 45/02; C22C 26/00; C22C 38/54; C22C 38/32

See application file for complete search history.

(56) References Cited

U.S. PATENT DOCUMENTS

| | | | | |
|---|---|---|---|---|
| 3,645,727 A * | 2/1972 | Finlay | C22C 1/02 420/429 |
| 4,050,931 A * | 9/1977 | Tanner | C22C 45/06 148/403 |
| 4,135,601 A | 1/1979 | Tsukagoshi et al. | |
| RE30,080 E * | 8/1979 | Tanner | C22C 45/10 148/403 |
| 4,470,479 A | 9/1984 | Inoue et al. | |

(Continued)

FOREIGN PATENT DOCUMENTS

| | | |
|---|---|---|
| CN | 87215838 U | 8/1988 |
| CN | 1303848 C | 3/2007 |

(Continued)

OTHER PUBLICATIONS

Sonicelectronix.com entitled "PowerBass L-6705x", Feb. 9, 2011, pp. 2 (Year: 2011).*

*Primary Examiner* — Fan S Tsang
*Assistant Examiner* — Angelica M McKinney
(74) *Attorney, Agent, or Firm* — Muncy, Geissler, Olds & Lowe, P.C.

(57) ABSTRACT

The present invention provides an acoustic diaphragm including: a cone and a surround mounted around the cone; wherein an amorphous titanium-zirconium film is formed on a cone substrate, a surround substrate, or both of the substrates. The present invention also provides a speaker containing the acoustic diaphragm.

3 Claims, 2 Drawing Sheets

(56) References Cited

U.S. PATENT DOCUMENTS

| | | | | |
|---|---|---|---|---|
| 4,854,980 | A * | 8/1989 | Raman | C22C 45/10 148/403 |
| 5,241,140 | A | 8/1993 | Itoh et al. | |
| 7,529,382 | B2 | 5/2009 | Babb | |
| 7,539,324 | B2 | 5/2009 | Polfreman et al. | |
| 2015/0172819 | A1* | 6/2015 | Wen | H04R 7/122 181/168 |
| 2018/0080109 | A1* | 3/2018 | Yokoyama | C22F 1/186 |
| 2018/0324526 | A1* | 11/2018 | Itano | H04R 31/003 |

FOREIGN PATENT DOCUMENTS

| | | | |
|---|---|---|---|
| CN | 100397953 | C | 6/2008 |
| CN | 1925696 | B | 10/2010 |
| CN | 201758445 | U | 3/2011 |
| CN | 104562140 | A | 4/2015 |
| CN | 204291352 | U | 4/2015 |
| TW | M358503 | U | 6/2009 |
| TW | 201410040 | A | 3/2014 |
| TW | M498432 | U | 4/2015 |

* cited by examiner

ACOUSTIC DIAPHRAGM AND SPEAKER CONTAINING THE SAME

CROSS REFERENCE

The non-provisional application claims priority from Taiwan Invention Patent Application No. 106117077, filed on May 24, 2017, the content thereof is incorporated by reference herein.

FIELD OF THE INVENTION

The present invention is directed to an acoustic diaphragm having an amorphous titanium-zirconium film and a speaker containing the acoustic diaphragm.

BACKGROUND OF THE INVENTION

The sound production principle of a speaker is the following. When an electric current passes through a wire coil, the wire coil generates a magnetic pole, and then the wire coil and a magnet repel or attract by their own poles. The repelling or attraction can lead to inward shrinkage or outward expansion of an acoustic diaphragm so as to form gas flow. Finally, the sound is produced by the formation of gas flow.

The material of the acoustic diaphragm is a factor for determining the sound quality. The currently-used acoustic diaphragm is made by forming a coating on a substrate. The material of the substrate is metal, plastic, fabric, or paper; the material of the coating is metal (e.g. nickel, gold, silver, copper, chromium, titanium, aluminum, iron, indium, zirconium, germanium, tantalum, tungsten, or beryllium), alloy (e.g. nickel-iron alloy, titanium-magnesium alloy, silver-tin alloy, beryllium alloy, titanium alloy, or boron alloy), oxide (e.g. aluminum oxide, titanium oxide, magnesium oxide, tantalum oxide, indium tin oxide, or silicon dioxide), diamond, carbon, boron, diamond-like carbon, carbide, boride, or nitride. See Taiwan Utility Patent No. M358503, Taiwan Utility Patent No. M498432, Taiwan Invention Patent No. I539836, China Utility Patent No. CN201758445U, China Utility Patent No. CN204291352U, China Utility Patent No. CN87215838U, China Invention Patent No. CN1925696B, China Invention Patent No. CN100397953C, China Invention Patent No. CN1303848C, China Invention Publication No. CN104562140A, American Utility Patent No. U.S. Pat. No. 4,135,601, American Utility Patent No. U.S. Pat. No. 7,529,382, American Utility Patent No. U.S. Pat. No. 4,470,479, American Utility Patent No. U.S. Pat. No. 5,241,140, and American Utility Patent No. U.S. Pat. No. 7,539,324.

As described above, there are various materials of the acoustic diaphragm. However, the user is more and more fastidious about the sound quality of a speaker, and therefore it is desirable to develop another acoustic diaphragm to satisfy the user's hearing needs.

SUMMARY OF THE INVENTION

An objective of the present invention is to provide an acoustic diaphragm, and the acoustic diaphragm includes: a cone; and a surround mounted around the cone; wherein an amorphous titanium-zirconium film is formed on a cone substrate, a surround substrate, or both of the substrates.

According to the present invention, the film composition and its ratio can impart various properties to the acoustic diaphragm, e.g. a high stiffness, a low specific density, or a high internal damping. When the acoustic diaphragm is mounted in a speaker, the sound distortion of the speaker can't appear.

Another objective of the present invention is to provide a speaker, and the speaker includes: a magnet, a wire coil mounted around the magnet, and an acoustic diaphragm as described previously positioned at an end of the wire coil.

DETAILED DESCRIPTION OF THE INVENTION

The detailed description and preferred embodiments of the invention will be set forth in the following content, and provided for people skilled in the art so as to understand the characteristics of the invention.

The inventor unexpectedly finds that an amorphous titanium-zirconium film can be provided with a high stiffness, a low specific density, or a high internal damping by adjusting the film composition and its ratio. As such, when the amorphous film is used as a part of an acoustic diaphragm of a speaker, the sound distortion of the speaker can't appear. Specifically, the high stiffness property can reduce partition vibration resulted from high frequency to efficiently prevent the sound distortion; the low specific density property can offer the acoustic diaphragm a high sensitivity to efficiently prevent the sound distortion; the high internal damping can enhance the absorption of vibration resulted from gas flow to efficiently prevent the sound distortion.

Figure 1:
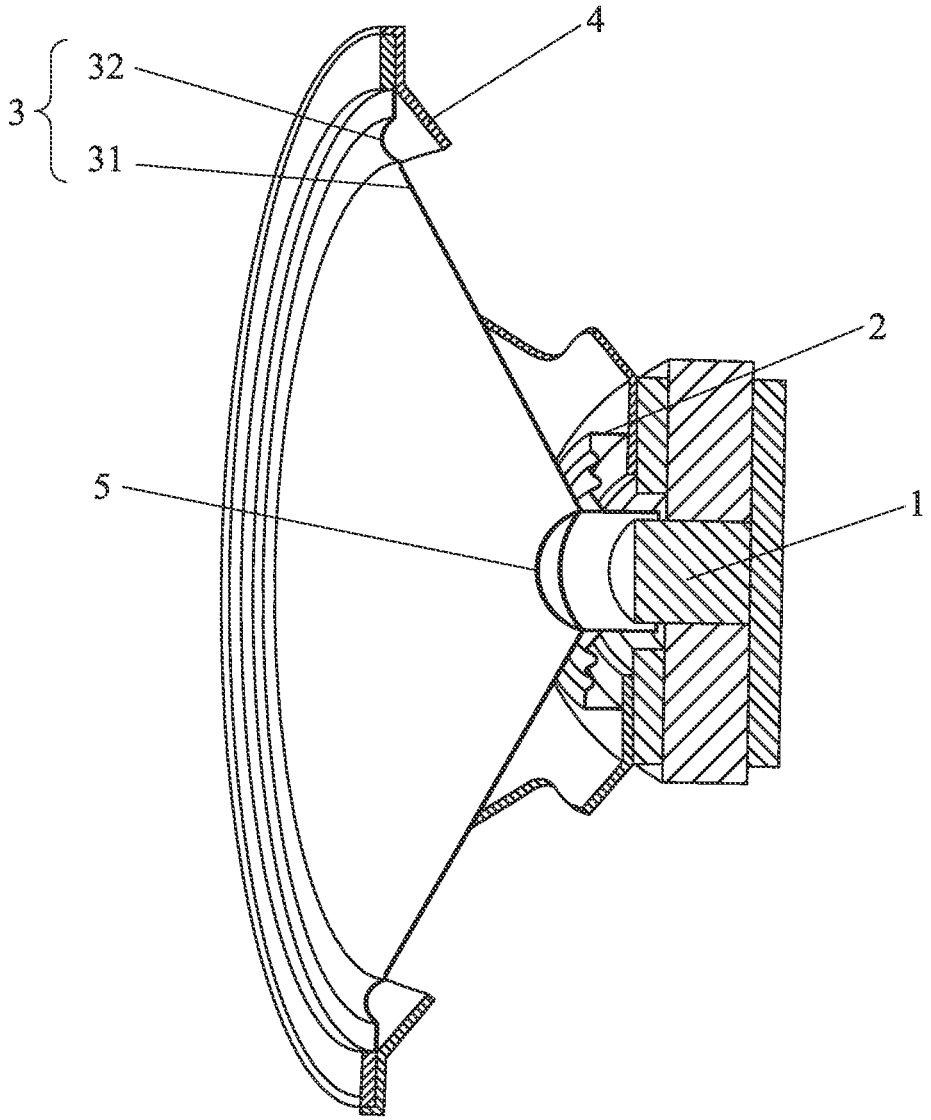
FIG. 1 is a schematic diagram showing a speaker in an embodiment of the present invention.

A speaker in an embodiment of the present invention is depicted in FIG. 1. The speaker herein may be a loudspeaker or a headset, and comprises: a magnet (1), a wire coil (2), an acoustic diaphragm (3), a frame (4), and a dust-proof membrane (5). The wire coil (2) is mounted around the magnet (1). The acoustic diaphragm (3) is positioned at an end of the wire coil (2). The frame (4) is connected to the acoustic diaphragm (3) for securing the acoustic diaphragm (3). The dust-proof membrane (5) partially or fully covers the acoustic diaphragm (3) so that dust particles can't adhere to the acoustic diaphragm (3) to preserve the sound reality.

Figure 2:
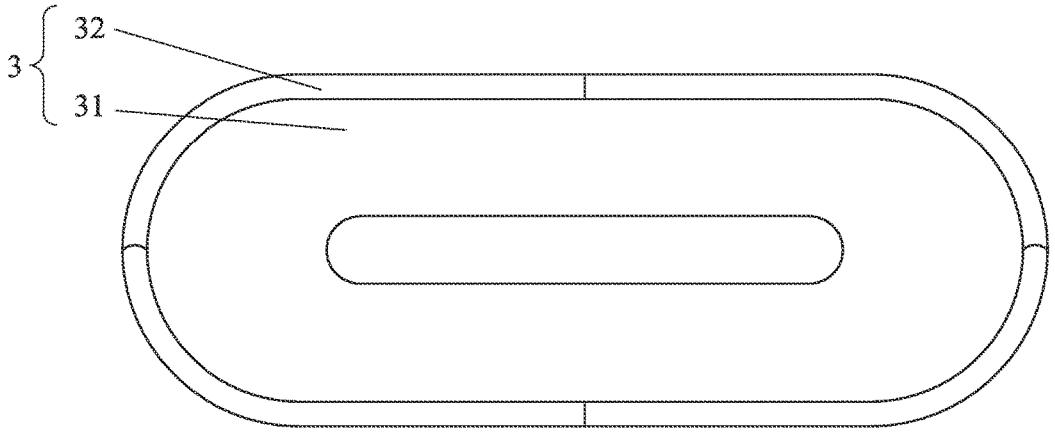
FIG. 2 is a schematic diagram showing an acoustic diaphragm of the foregoing speaker.

As shown in FIG. 2, the acoustic diaphragm (3) according to the embodiment comprises: a cone (31) and a surround (32). The surround (32) is mounted around the cone (31), and an amorphous titanium-zirconium film is formed on a cone (31) substrate, a surround (32) substrate, or both of the substrates. An example of the amorphous titanium-zirconium film is but not limited to a zirconium-titanium-iron metallic glass, a titanium-zirconium-boron metallic glass, a titanium-zirconium-boron-nitrogen metallic glass, a titanium-tungsten-zirconium metallic glass, a zirconium-titanium-iron diamond-like film, or a titanium-tungsten-zirconium diamond-like film. It is noted the term "metallic glass" and the term "amorphous film" are used synonymously and refer to a film having metal atoms therein in disorder; the term "diamond-like film" refers to a film having carbon atoms linked with $sp^2$ and $sp^3$ hybrid orbitals, and therefore having properties similar to those of a diamond film, whose carbon atoms are all linked with $sp^3$ hybrid orbitals.

In some examples, the amorphous titanium-zirconium film is a zirconium-titanium-iron metallic glass. Under such condition, the amorphous titanium-zirconium film contains 40 at %-45 at % of zirconium, 18 at %-25 at % of titanium, and 35 at %-40 at % of iron, and has a plastic modulus of 100-120 GPa and a specific density of 6.6-7.0.

In other examples, the amorphous titanium-zirconium film is a titanium-zirconium-boron metallic glass. Under such condition, the amorphous titanium-zirconium film contains 30 at %-36 at % of zirconium, 44 at %-49 at % of titanium, and 15 at %-22 at % of boron, and has a plastic modulus of 140-180 GPa and a specific density of 4.5-5.7.

In further examples, the amorphous titanium-zirconium film is a titanium-zirconium-boron-nitrogen metallic glass. Under such condition, the amorphous titanium-zirconium film contains 29 at %-35 at % of zirconium, 43 at %-48 at % of titanium, 16 at %-22 at % of boron, and 4 at %-10 at % of nitrogen, and has a plastic modulus of 170-210 GPa and a specific density of 4.0-4.7.

In still other examples, the amorphous titanium-zirconium film is a zirconium-titanium-iron metallic glass. Under such condition, the amorphous titanium-zirconium film contains 54 at %-60 at % of zirconium, 27 at %-33 at % of titanium, and 12 at %-18 at % of iron, and has a plastic modulus of 80-90 GPa and a specific density of 6.0-6.2.

In yet other examples, the amorphous titanium-zirconium film is a titanium-tungsten-zirconium metallic glass. Under such condition, the amorphous titanium-zirconium film contains 30 at %-35 at % of zirconium, 35 at %-40 at % of titanium, and 30 at %-35 at % of tungsten, and has a plastic modulus of 110-120 GPa and a specific density of 10.0-10.5.

In additional examples, the amorphous titanium-zirconium film is a zirconium-titanium-iron diamond-like film. Under such condition, the amorphous titanium-zirconium film contains 1 at %-3 at % of zirconium, 1 at %-3 at % of titanium, 1 at %-5 at % of iron, and the remainder carbon, and a plastic modulus of 150-180 GPa and a specific density of 2.8-3.2.

In certain examples, the amorphous titanium-zirconium film is a titanium-tungsten-zirconium diamond-like film. Under such condition, the amorphous titanium-zirconium film contains 1 at %-3 at % of zirconium, 1 at %-3 at % of titanium, 1 at %-5 at % of tungsten, and the remainder carbon, and has a plastic modulus of 150-180 GPa and a specific density of 2.8-3.2.

The compositions and physical properties of films in various examples of the present invention are listed in Table 1.

TABLE 1

| film | composition (at. %) | | | | | | | | plastic modulus | specific |
|---|---|---|---|---|---|---|---|---|---|---|
| | Zr | Ti | Fe | W | B | N | C | O | (GPa) | density |
| Zr-Ti-Fe metallic glass | 40-45 | 18-25 | 35-40 | — | — | — | — | <5 | 100-120 | 6.6-7.0 |
| Ti-Zr-B metallic glass | 30-35 | 44-48 | — | — | 16-22 | — | — | <5 | 140-180 | 4.5-5.7 |
| Ti-Zr-B-N metallic glass | 30-35 | 44-48 | — | — | 16-22 | 5-10 | — | <5 | 170-210 | 4.0-4.7 |
| Zr-Ti-Fe metallic glass | 54-60 | 27-33 | 12-18 | — | — | — | — | <5 | 80-90 | 6.0-6.2 |
| Ti-W-Zr metallic glass | 30-35 | 35-40 | — | 30-35 | — | — | — | <5 | 110-120 | 10.0-10.5 |
| Zr-Ti-Fe diamond-like film | 1-3 | 1-3 | 1-5 | — | — | — | 89-97 | <5 | 150-180 | 2.8-3.2 |
| Ti-W-Zr diamond-like film | 1-3 | 1-3 | — | 1-5 | — | — | 89-97 | <5 | 150-180 | 2.8-3.2 |

It is concluded from Table 1 that: (1) a Zr—Ti—Fe metallic glass is a film having a medium plastic modulus, a medium density, and a high damping, and therefore it is suitable to be deposited on a cone substrate or a surround substrate of an acoustic diaphragm; (2) a Ti—Zr—B metallic glass, a Ti—Zr—B—N metallic glass, a Zr—Ti—Fe diamond-like film, and a Ti—W—Zr diamond-like film are films each having a high plastic modulus and a low density, and therefore they are suitable to be deposited on a cone substrate of an acoustic diaphragm; (3) a Zr—Ti—Fe metallic glass and a Ti—W—Zr metallic glass are films each having a low plastic modulus, a high density, and a high damping, and therefore they are suitable to be deposited on a cone substrate of an acoustic diaphragm.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An acoustic diaphragm, comprising:

a cone; and a surround mounted around the cone;

wherein an amorphous titanium-zirconium film is formed on a cone substrate, a surround substrate, or both of the substrates;

wherein the amorphous titanium-zirconium film is a titanium-zirconium-boron metallic glass and contains 30 at %-36 at % of zirconium, 44 at %-49 at % of titanium, and 15 at %-22 at % of boron.

2. An acoustic diaphragm, comprising:

a cone; and a surround mounted around the cone;

wherein an amorphous titanium-zirconium film is formed on a cone substrate, a surround substrate, or both of the substrates;

wherein the amorphous titanium-zirconium film is a titanium-zirconium-boron-nitrogen metallic glass and contains 29 at %-35 at % of zirconium, 43 at %-48 at % of titanium, 16 at %-22 at % of boron, and 4 at %-10 at % of nitrogen.

3. An acoustic diaphragm, comprising:

a cone; and a surround mounted around the cone;

wherein an amorphous titanium-zirconium film is formed on a cone substrate, a surround substrate, or both of the substrates;

wherein the amorphous titanium-zirconium film is a titanium-tungsten-zirconium diamond-like film and contains 1 at %-3 at % of zirconium, 1 at %-3 at % of titanium, 1 at %-5 at % of tungsten.

* * * * *